US007118102B1

(12) United States Patent
Werner

(10) Patent No.: US 7,118,102 B1
(45) Date of Patent: Oct. 10, 2006

(54) ROCKER PLATE FOR SEPARATING SHEETS

(75) Inventor: Todd C. Werner, St. Pete Beach, FL (US)

(73) Assignee: Pitney Bowes Inc., Stamford, CT (US)

( * ) Notice: Subject to any disclaimer, the term of this patent is extended or adjusted under 35 U.S.C. 154(b) by 17 days.

(21) Appl. No.: 10/708,612

(22) Filed: Mar. 15, 2004

(51) Int. Cl.
*B65H 31/38* (2006.01)

(52) U.S. Cl. ..... 271/210; 271/221

(58) Field of Classification Search ..... 271/146, 271/210, 145, 117, 221, 301
See application file for complete search history.

(56) References Cited

U.S. PATENT DOCUMENTS

| | | | | | |
|---|---|---|---|---|---|
| 2,629,592 | A | * | 2/1953 | Line, Jr. | 271/210 |
| 3,062,539 | A | * | 11/1962 | Obenshain | 271/210 |
| 3,089,697 | A | * | 5/1963 | Brozo | 271/34 |
| 3,334,890 | A | * | 8/1967 | La Bombard et al. | 271/4.09 |
| 3,545,741 | A | * | 12/1970 | Porth | 270/58.1 |
| 3,559,984 | A | * | 2/1971 | Westra | 271/210 |
| 4,319,741 | A | * | 3/1982 | Okamoto | 271/118 |
| 4,674,736 | A | * | 6/1987 | Tsubo | 271/122 |
| 5,228,673 | A | * | 7/1993 | Osonoe | 271/10.01 |
| 5,552,859 | A | * | 9/1996 | Nakagawa et al. | 399/23 |
| 6,113,093 | A | * | 9/2000 | Morinaga et al. | 271/162 |
| 6,315,286 | B1 | * | 11/2001 | Muenchinger et al. | 271/146 |
| 6,402,135 | B1 | | 6/2002 | Werner | |
| 2005/0067754 | A1 | * | 3/2005 | Shigenaga et al. | 271/30.1 |

FOREIGN PATENT DOCUMENTS

| | | | |
|---|---|---|---|
| JP | 61023077 | A * | 1/1986 |
| JP | 62126055 | A * | 6/1987 |

* cited by examiner

*Primary Examiner*—Gene O. Crawford
*Assistant Examiner*—Matthew J. Kohner
(74) *Attorney, Agent, or Firm*—Michael J. Cummings; Steven J. Shapiro; Angelo N. Chaclas

(57) ABSTRACT

A sheet feeder includes a bin into which items are stacked. The items are sequentially removed from the bottom of the stack as the sheet feeder operates. The items travel a longitudinal path of travel to a separator wheel that staggers the items as they exit the sheet feeder. A rocker plate at the bottom of the bin oscillates to jostle the items. The jostling breaks the bonds of friction between contiguous items so that the items are not bound to one another as they engage the separator wheel. A drive shaft transverse to the path of item travel rotates as the sheet feeder operates and carries a cam that rotates conjointly with the drive shaft and causes oscillation of a cam follower. The cam follower oscillates a transversely disposed bar about a transverse axis and the rocker plate is mounted to that bar.

2 Claims, 2 Drawing Sheets

ROCKER PLATE FOR SEPARATING SHEETS

BACKGROUND OF INVENTION

1. Field of the Invention

This invention relates, generally, to high speed sheet feeders. More particularly, it relates to a rocker plate that separates contiguous sheets from one another as they exit a sheet feeder bin and enter into a gate having a separator wheel.

2. Description of the Prior Art

U.S. Pat. No. 6,402,135 to the present inventor, entitled Sheet Feeder For Handling Sheets Of Varying Thickness, represents the prior art most relevant to the present invention. That patent discloses a large-in-diameter separator wheel and a shroud member having a first straight part, a curved second part having a radius of curvature that corresponds to the curvature of the separator wheel, and a second straight part.

The first straight part guides vertically stacked sheets in a bin as they descend to the bottom of the bin as sheets are sequentially removed from the bottom of the bin. The curved second part creates a stagger between contiguous sheets, and the third straight part is parallel to a conveyor that sequentially removes sheets from the bottom of the bin. A slot is formed in the second straight part to enable the sheets to be engaged by the separator wheel as said sheets are pulled from the bottom of the bin by the conveyor. The curvature of the shroud and the separator wheel cooperate to impart a stagger to the sheets. By varying the position of the separator wheel, sheets or articles of varying thickness may be dispensed at high speed from the bin. For example, items as thin as a single sheet of paper or as thick as a cassette tape can be dispensed.

In the prior art preceding U.S. Pat. No. 6,402,135, separate machines were required to handle thin items and thick items. Thus, the provision of the large-in-diameter separator wheel cut in half the cost of machinery required to operate a high speed paper-handling facility.

When a large number of items are stacked in a vertical bin, however, the pressure on the items at the bottom of the bin may create a frictional bond between contiguous items. Despite the curvature of the shroud, there are times when two or more items are bonded to one another by a frictional bond that does not break when the curvature is encountered.

There is a need, then, for a frictional bond-breaking means that separates items from one another at the bottom of the bend as they encounter the curvature of the shroud.

However, in view of the prior art considered as a whole at the time the present invention was made, it was not obvious to those of ordinary skill in the pertinent art how such need could be fulfilled.

SUMMARY OF INVENTION

The long-standing but heretofore unfulfilled need for a means that prevents or reduces jamming of sheet feeders is now met by a new, useful, and nonobvious invention.

The novel apparatus separates from one another contiguous items in a substantially vertical stack that are frictionally engaged to one another so that the items are staggered upon entering into a sheet feeder. A rocker plate is positioned at a lowermost end of the vertical stack and a rocking means causes the rocker plate to oscillate in a vertical plane as the sheet feeder operates. Items in the bin are therefore jostled by the oscillation of the rocker plate. The jostling breaks frictional bonds between contiguous items.

The items are adapted to follow a longitudinal path of travel upon entering into the sheet feeder. A rocker bar is transversely disposed relative to the longitudinal path of travel and is mounted for pivotal movement about a transversely disposed axis. The rocker plate is fixedly secured to the pivotally mounted rocker bar and the rocking means is connected to the rocker bar.

A drive shaft is transversely disposed relative to the longitudinal path of travel and rotates about its axis or rotation when the sheet feeder is operating. Accordingly, its rotational speed varies with the speed of the sheet feeder.

A cam is secured to the drive shaft for conjoint rotation therewith and a cam follower is biased to bear against the cam. The cam follower is connected to the rocker bar and causes the rocker bar to reciprocate about its transversely disposed axis when the drive shaft is rotating.

A base plate slideably overlies the rocker plate and is adjustably mounted relative to a longitudinal axis to accommodate items in the bin of differing longitudinal extents. The base plate carries a plurality of ears that have a downwardly inclined forward surface that urges the respective trailing ends of the items being fed into the sheet feeder in a forward direction.

An important object of this invention is to provide an apparatus that separates from one another vertically stacked items that have become frictionally bonded to one another due to gravitational force applied to said items.

A closely related object is to provide a means for jostling the vertically stacked items with a force sufficient to overcome the frictional bonds of force between contiguous items.

Yet another object is to link the jostling speed with the rate of operation of a sheet feeder so that the jostling speed slows down and increases with the slowing down and speed increase of a sheet feeder, respectively.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
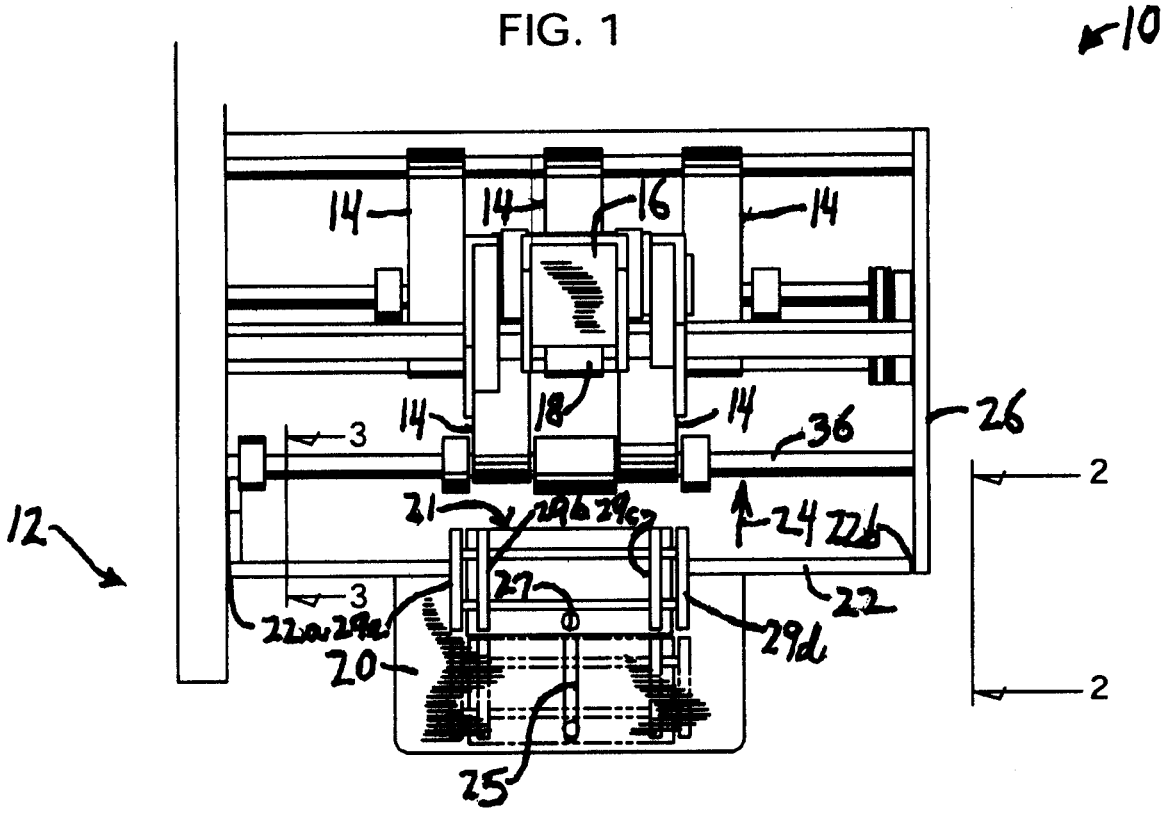
FIG. 1 is a top plan view of a sheet feeder equipped with the novel rocker plate.

Referring to FIG. 1, it will there be seen that the reference numeral 10 denotes an illustrative embodiment of the novel sheet feeder as a whole.

Novel structure 10 includes a conventional vertical bin 12 for holding a stack of items, not shown, that may include sheets of paper, envelopes, cassette tapes, and other flat items of varying thickness. As best understood in connection with FIG. 2, a pair of laterally spaced apart guide members, only one of which is depicted and denoted 13 in the side elevational view of said FIG. 2, holds the items in said vertical stack. Guides 13 are transversely adjustable to accommodate items of differing widths but they are otherwise mounted to a stationary frame and do not rock back and forth with the novel rocking mechanism of this invention.

Conveyor means 14 (FIG. 1) at the bottom of bin 12 carries the lowermost item in the bin into contact with separator wheel 16. Shroud 18 prevents contact between the items and the separator wheel but has a radius of curvature that corresponds to the radius of the separator wheel so that the items are staggered as they approach the bottom of the bin. Upon reaching the bottom of the bin, each item is engaged by separator wheel 18 through a slot formed in the second straight section of the separator wheel as mentioned above, and such engagement produces a controlled staggering between the items as they exit the bin. U.S. Pat. No. 6,402,135 to the present inventor, entitled Sheet Feeder For Handling Sheets Of Varying Thickness, explains the process in more detail and is hereby incorporated into this disclosure by reference.

If two items remain frictionally bonded to one another, despite the curvature of the shroud, both try to enter into engagement with the separator wheel at the same time and a jam occurs. The machine must then be stopped and a machine operator has to overcome the jam before restarting the machine.

The novel mechanism reduces or eliminates such jamming and downtime.

Rocker plate 20 is positioned at the bottom of bin 12 and thus supports the weight of all items stacked therewithin. It is fixedly secured to transversely disposed bar 22, said bar being transversely disposed relative to a longitudinal path of travel of the items as they exit the bin as denoted by single-headed reference arrow 24.

Figure 2:
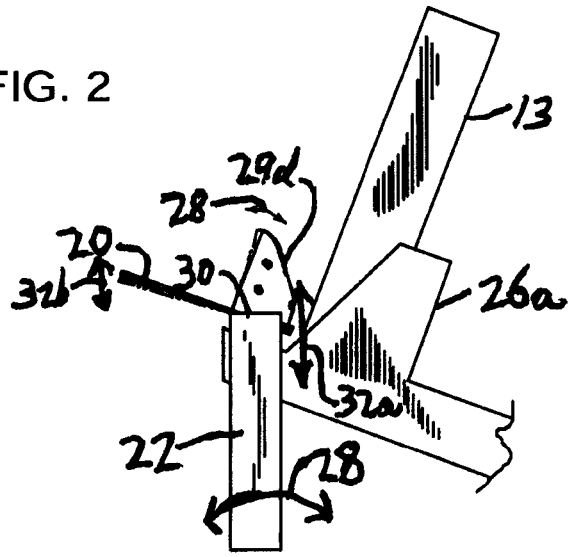
FIG. 2 is a side elevational view taken along line 2—2 in FIG. 1.

Transverse bar 22 is mounted to frame 26 at pivot points 22*b*, 22*b* so that it can pivot back and forth as indicated by double-headed directional arrow 28 in FIG. 2. It has a flat top wall 30 to which rocker plate 20 is fixedly secured.

Base plate 21 overlies rocker plate 20 and is slideably adjustable relative thereto. Specifically, longitudinally-extending slot 25 (FIG. 1), formed in rocker plate 20, enables the position of base plate 21 to be longitudinally adjusted to accommodate items of varying sizes. Aperture 27 is formed in base plate 21 to screw threadedly receive the stem of a locking screw, not shown. The stem extends through said slot but the head of the screw does not. A nut engages the screw on the underside of the rocker plate. Accordingly, the nut is loosened to enable longitudinal re-positioning of base plate 21 relative to rocker plate 20 and said nut is re-tightened when the new position is reached. In FIG. 1, the forwardmost position of base plate 21 is depicted in solid lines and its rearwardmost position is depicted in phantom lines. The forwardmost position is used when articles of short longitudinal extent are being fed from bin 12 into the sheet feeder, and the rearwardmost position is used when articles of longer longitudinal extent are being fed from said bin into said sheet feeder. Base plate 21 may be positioned in an infinite plurality of positions of functional adjustment between said two extreme positions to accommodate items of any size between said maximum and minimum sizes.

Upstanding ears 29*a*, 29*b*, 29*c*, and 29*d* are mounted to base plate 21 and thus rock back and forth concomitantly therewith. They are laterally adjustable along the transverse extent of base plate 21 to accommodate items of varying widths. As best understood in connection with FIG. 2, each ear has a beveled, downwardly inclined forward or leading surface. The respective trailing ends of the sheets (not shown) that are being fed by sheet feeder 10 to a raceway (not shown) below said sheet feeder slide down such beveled or downwardly inclined surface and said trailing ends are continuously jostled as they do so by the rocking action of rocker plate 20.

In FIG. 2, base plate 21 and hence ears 29*a*, 29*b*, 29*c*, and 29*d* carried thereby are shown at their forwardmost position to accommodate items of minimal longitudinal extent. It should be understood that all sheets are between ears 29*a–d* and the leading edges of guides 13.

As transverse bar 22 reciprocates about pivot points 22*a*, 22*b*, the leading and trailing ends of rocker plate 20 rock up and down as indicated by double-headed directional arrows 32*a* (leading end), 32*b* (trailing end) in FIG. 2. This rocking action jiggles the items in the bin and breaks the frictional bond between contiguous items.

In FIG. 2, the part denoted 26*a* is a part of frame 26 and does not move. It is downwardly sloped and delivers sheets to the aforementioned raceway.

Figure 3:
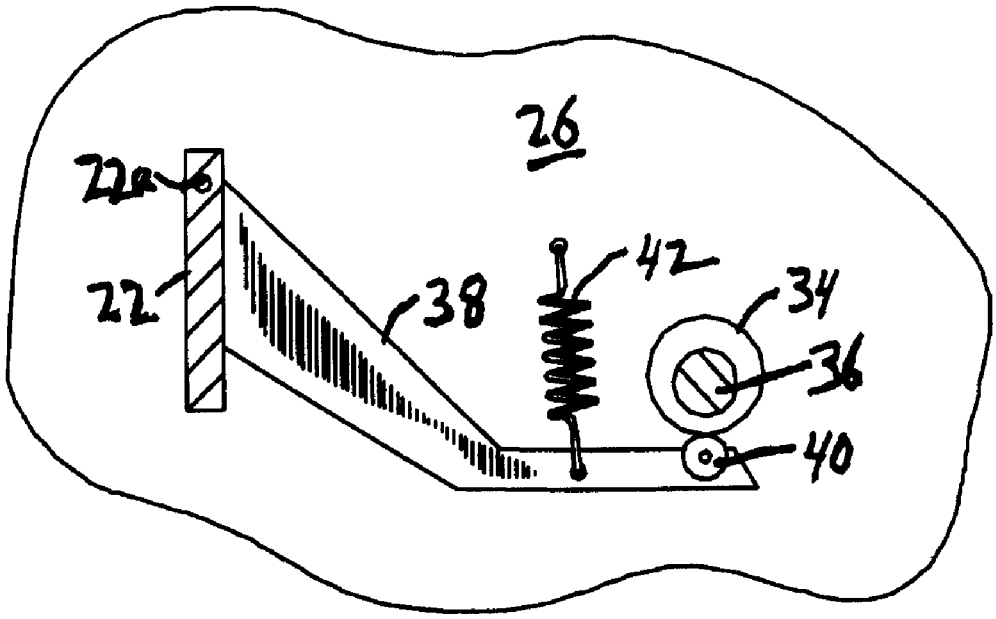
FIG. 3 is a sectional view taken along line 3—3 in FIG. 1.
Figure 4:
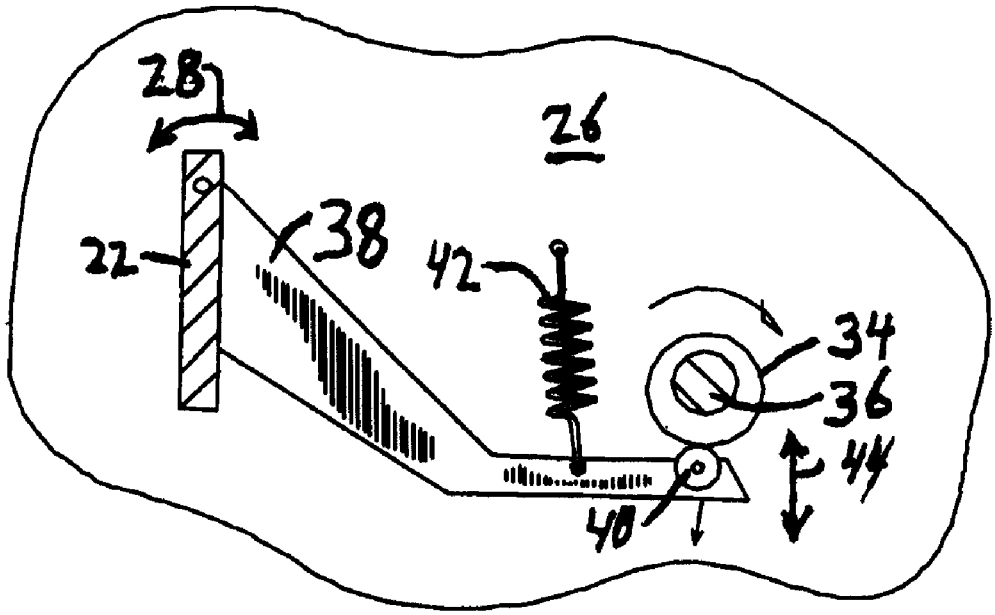
FIG. 4 is a view like FIG. 3, but showing how the parts are displaced upon the rotation of the cam.

FIGS. 3 and 4 depict a cam and cam follower arrangement that effect the reciprocation of transverse bar 22 and hence the rocking action of rocker plate 20. Cam 34 is mounted on transversely disposed drive shaft 36 and rotates conjointly therewith. In a preferred embodiment, cam 34 has four lobes but of course such number of lobes is not critical. Rigid link member 38 serves as a cam follower and interacts with cam 34 through rotatably mounted roller 40. Roller 40 is biased by biasing means 42 to rotatably bear against cam 34 so that roller 40 and hence link member 38 is oscillated in a vertical plane as indicated by double-headed directional arrow 44 in FIG. 4 as cam 34 rotates. A second end of cam follower 38 therefore alternately pushes and pulls on transverse bar 22, causing it to oscillate as indicated by double-headed directional arrow 28 in FIG. 4 and thereby causing rocker plate 20 to rock in the above-described manner.

Machine designers of ordinary skill will be aware of other ways to make rocker plate 20 rock as disclosed herein. Numerous other cam and cam follower arrangements could be employed without departing from the teachings and suggestions of this invention. Moreover, linkages that do not rely upon cams and cam followers could also be employed. For example, the plunger of a solenoid could be engaged to transverse bar 22 and timed electrical signals could cause extension and retraction of the plunger to achieve the desired reciprocation of said transverse bar 22. The timing of the electrical signals could be computer-controlled so that rocker plate 20 rocks faster as the machine speeds up and slower as the machine slows down. The simple cam and cam follower arrangement is preferred because the cam rotates conjointly with drive shaft 36 as aforesaid so the speed of the reciprocation of rocker plate 20 follows the speed of said shaft in the absence of sensors, logic circuitry, and other electronic components.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. An apparatus for separating from one another contiguous items in a substantially vertical stack that are frictionally engaged to one another, so that said items are disengaged from one another upon entering into a sheet feeder, comprising:

a rocker plate positioned at a lowermost end of said vertical stack;

said rocker plate adapted to support said stack of contiguous items;

rocking means for causing said rocker plate to oscillate in a vertical plane as said sheet feeder operates;

said items being adapted to follow a longitudinal path of travel upon entering into said sheet feeder;

a rocker bar transversely disposed relative to said longitudinal path of travel;

said rocker bar being positioned in a substantially vertical plane;

said rocker bar being mounted for pivotal movement about a transversely disposed axis;

said rocker plate being fixedly secured to a flat top wall of said pivotally mounted rocker bar;

said rocking means being connected to said rocker bar;

said rocking plate when oscillating in said vertical plane, causing said items to oscillate in said vertical plane;

said rocker plate adapted to oscillate in said vertical plane when said apparatus is operating;

whereby items in said bin are jostled by said oscillation of said rocker plate, said jostling breaking frictional bonds between contiguous items; and a drive shaft transversely disposed relative to said longitudinal path of travel;

said drive shaft rotating about its axis of rotation when said sheet feeder is operating;

a cam secured to said drive shaft for conjoint rotation therewith;

a cam follower biased to bear against said cam;

said cam follower being connected to said rocker bar and causing said rocker bar to reciprocate about said transversely disposed axis when said drive shaft is rotating;

a longitudinally extending slot formed in said rocker plate;

an aperture formed in said base plate; and a screw having a stem that extends through said aperture and through said slot;

said screw having a head with a diameter greater than a breadth of said aperture and a nut that engages said stem on an underside of said rocker plate so that said base plate is adjustable along the length of said slot when said nut is loosened and so that said base plate is held into a preselected position when the nut is tightened.

2. An apparatus for separating from one another contiguous items in a substantially vertical stack that are frictionally engaged to one another, so that said items are disengaged from one another upon entering into a sheet feeder, comprising:

a rocker plate positioned at lowermost end of said vertical stack;

rocking means for causing said rocker plate to oscillate as said sheet feeder operates;

said items being adapted to follow a longitudinal path of travel upon entering into said sheet feeder;

a rocker bar transversely disposed relative to said longitudinal path of travel;

said rocker bar being mounted for pivotal movement about a transversely disposed axis;

said rocker plate being fixedly secured to said pivotally mounted rocker bar;

said rocking means being connected to said rocker bar;

a drive shaft transversely disposed relative to said longitudinal path of travel;

said drive shaft rotating about its axis of rotation when said sheet feeder is operating;

a cam secured to said drive shaft for conjoint rotation therewith;

a cam follower biased to bear against said cam;

said cam follower being connected to said rocker bar and causing said rocker bar to reciprocate about said transversely disposed axis when said drive shaft is rotating;

a base plate that overlies said rocker plate and that is longitudinally adjustably mounted relative to said rocker plate to accommodate items in said bin of differing longitudinal extents;

a longitudinally extending slot formed in said rocker plate;

an aperture formed in said base plate;

a screw having a stem that extends through said aperture and through said slot; and said screw having a head with a diameter greater than a breadth of said aperture and a nut, that engages said stem on an underside of said rocker plate so that said base plate is adjustable along the length of said slot when said nut is loosened and so that said base plate is held into a preselected position when the nut is tightened;

whereby items in said bin are jostled by said oscillation of said rocker plat, said jostling breaking frictional bonds between contiguous items.

* * * * *